US007248155B2

(12) United States Patent
Wang et al.

(10) Patent No.: US 7,248,155 B2
(45) **Date of Patent: *Jul. 24, 2007**

(54) SECURITY DEVICE WITH BUILT-IN INTERCOMMUNICATED FALSE ALARM REDUCTION CONTROL

(76) Inventors: Randall Wang, 4978 Santa Anita Ave., Temple City, CA (US) 91780; James Parker, 4978 Santa Anita Ave., Temple City, CA (US) 91780

( * ) Notice: Subject to any disclaimer, the term of this patent is extended or adjusted under 35 U.S.C. 154(b) by 195 days.

This patent is subject to a terminal disclaimer.

(21) Appl. No.: 11/124,630

(22) Filed: May 6, 2005

(65) Prior Publication Data

US 2006/0250231 A1 Nov. 9, 2006

(51) Int. Cl.
*G08B 29/00* (2006.01)

(52) U.S. Cl. ..... 340/507; 340/506; 340/524; 340/525; 340/825.36; 340/825.49; 340/3.1

(58) Field of Classification Search ..... 340/506, 340/507, 524, 525, 825.36, 825.49, 3.1
See application file for complete search history.

(56) References Cited

U.S. PATENT DOCUMENTS 4,833,449 A * 5/1989 Gaffigan ..... 340/505
4,857,912 A * 8/1989 Everett, Jr. et al. ..... 340/508
5,736,927 A * 4/1998 Stebbins et al. ..... 340/506
6,084,509 A * 7/2000 Simpson, Sr. ..... 340/506
6,137,411 A * 10/2000 Tyren ..... 340/572.1

* cited by examiner

*Primary Examiner*—Daryl C Pope
(74) *Attorney, Agent, or Firm*—Raymond Y. Chan; David and Raymond Patent Group

(57) ABSTRACT

A security device includes a plurality of security detectors intercommunicating with each other. Each of the security detectors includes a first device for verifying a single zone verification time of the respective security detector and a second device for verifying a multiple zone verification time with another security detector corresponding to a distance between two security detectors at two different detecting areas. When one of the security detectors detects at least two triggered signals in the respective detecting area within the single zone verification time, the respective security detector activates the local warning system to produce a local warning signal. When two security detectors are intercommunicated with each other to detect two triggered signals in the detecting areas respectively within the multiple zone verification time, at least one of the security detectors activates the local warning system to produce the local warning signal.

21 Claims, 16 Drawing Sheets

SECURITY DEVICE WITH BUILT-IN INTERCOMMUNICATED FALSE ALARM REDUCTION CONTROL

BACKGROUND OF THE PRESENT INVENTION

1. Field of Invention

The present invention relates to an alarm system, and more particularly to a security device with built-in intercommunicated false alarm reduction control, which can optimize both the false alarm reduction performance and the security protection performance.

2. Description of Related Arts

It is reported that less than 5% of the triggered alarms are caused by actual illegal events. More than 90% of the triggered alarms are false alarms caused by the motion sensors and humans mis-operations. False alarms are the unsolved troubles to both the alarm companies and the police resources. Most alarm owners have the unpleasant experience of being awaken in mid-night by the alarm company due to false alarms. Moreover, unaccountable waste of time and police force have been suffered by most of the policemen. Before the policemen arrive at the scene, no one knows whether it is a false alarm or an actual alarm. Therefore, the local police resource charges the alarm owner a pretty high amount for a false alarm operation fee for each false alarm which causes a lot of complaints from users also. It creates a great burden to the limited police force in every city. In fact, millions of expenses have been wasted for the police resources in responding to the false alarms, that greatly degrades the efficiency and performance of the police. Accordingly, some of the police stations in this country consider abandoning such alarm response service. It will only be good news to all burglars. Therefore, how to effectively minimize the possibility of false alarm becomes an urgent topic to both the alarm users and the police resources.

As shown in FIG. 16, a verification process seems to be the only solution today wherein the alarm system provides a verification condition to delay the activation of the control plane so as to reduce the false alarm possibility. The verification process is performed when one of the motion sensors detects a trigger motion within a respective motion detecting area, a motion signal is delayed for a preset time period as a single zone delaying period to send to the control panel. Therefore, the control panel is activated to normally respond by activating the local warning system to produce warning signals when the same motion sensor that detected the trigger motion detects another motion in the same motion detecting area within the single zone delaying period. In other words, the motion sensor can only detect the trigger motion and sent the signal to the control panel such that the motion sensor is a one-way communication device that the motion sensors cannot intercommunicate with each other. Statistically, between year 2000 and 2002 when the alarm system incorporates with the verification process, the total false alarm reports were significantly reduced to 2% in comparison with the alarm system without the verification process.

However, since each building has its own interior structure, the single zone delaying period for each motion sensor must be preset correspondingly. When the motion sensor has a longer single zone delaying period, the false alarm possibility will be reduced. However, the security protection of the alarm system will also be reduced. In other words, when the motion sensor has a shorter single zone delaying period to enhance the security protection of the alarm system, the false alarm possibility will be highly increased.

In addition, when multiple zones are involved in the alarm system, another motion sensor is preset as a cross zone delaying period. However, the time frame of the cross zone delaying period is an unknown to optimize both the false alarm reduction and the security protection.

The conventional time zone setting for the multiple zone alarm system is that the cross zone delaying period is set as same as the single zone delaying period. However, such time zone setting not only highly increases the false alarm possibility but also reduces the security protection performance. In other words, the settings of the single zone delaying period and the cross zone delaying period are relied on the experienced technician.

SUMMARY OF THE PRESENT INVENTION

A main object of the present invention is to provide a security device with built-in intercommunicated false alarm reduction control, which can optimize both the false alarm reduction performance and the security protection performance.

Another object of the present invention is to provide a security device with built-in intercommunicated false alarm reduction control, wherein a plurality of security detectors are intercommunicated with each other such that when one of the security detectors detects a suspected event within a detecting area thereof, the rest of the security detectors are triggered at a standby mode.

Another object of the present invention is to provide a security device with built-in intercommunicated false alarm reduction control, wherein the time frames of the single zone verification time and the multiple zone verification time of each of the security detectors can be preset through the verification control process of the false alarm reduction control so as to minimize the false alarm possibility without reducing the security protection.

Another object of the present invention is to provide a security device with built-in intercommunicated false alarm reduction control, wherein the verification control process of each of the security detectors comprises a single zone verification analysis for analyzing the performance of the false alarm reduction and security protection with respect to the single zone verification time and a multiple zone verification analysis for analyzing the performance of the false alarm reduction and security protection with respect to the multiple zone verification time. Therefore, the optimum verification time of each of the security detectors is determined by the single zone verification time from the single zone verification analysis and the multiple zone verification time from the multiple zone verification analysis.

Another object of the present invention is to provide a security device with built-in intercommunicated false alarm reduction control, wherein the verification control process of each of the security detectors can substantially reduce the false alarm rate to below 0.5% in comparison with the alarm system without the verification control process.

Another object of the present invention is to provide a security device with built-in intercommunicated false alarm reduction control, wherein the verification control process of each of the security detectors fits for any alarm system installed into different structural designs of the building since both the single zone verification analysis and the multiple zone verification analysis must be performed to determine the optimum single zone verification time and the optimum multiple zone verification time.

Another object of the present invention is to provide a security device with built-in intercommunicated false alarm reduction control, wherein no expensive or complicated structure is required to employ in the present invention in order to achieve the above mentioned objects. Therefore, the present invention successfully provides an economic and efficient solution for enhancing not only the false alarm reduction performance but also the security protection performance.

Accordingly, in order to accomplish the above objects, the present invention provides a security device for connecting to a local warning system comprising a control center and a plurality of security detectors which is electrically connected to the control center to intercommunicate with each other, wherein the security detectors are installed at a plurality of detecting areas respectively. Each of the security detectors comprises an intercommunicated false alarm reduction control comprising:

first means for verifying a single zone verification time of the respective security detector, wherein the single zone verification time is a single senor time delay for delaying an activation of the local warning system while the respective security detector is triggered; and second means for verifying a multiple zone verification time with another security detector corresponding to a distance between two security detectors at two different detecting areas, wherein the multiple zone verification time is a multiple senor time delay for delaying the activation of the local warning system while the two security detectors at two different detecting areas are triggered, wherein the multiple zone verification time is longer than the single zone verification time.

When one of the security detectors detects at least two triggered signals in the respective detecting area within the single zone verification time, the respective security detector activates the control center for activating the local warning system to produce a local warning signal.

When two security detectors are intercommunicated with each other to detect two triggered signals in the detecting areas respectively within the multiple zone verification time, at least one of the security detectors activates the control center for activating the local warning system to produce the local warning signal.

The present invention further comprises a process of a verification control for a security device which comprises a control center and a plurality of security detectors installed at a plurality of detecting areas respectively and electrically connected to the control center, comprising the steps of:

(a) intercommunicating the security detectors with each other;

(b) verifying a single zone verification time for each of the security detectors, wherein when one of the security detectors detects at least two triggered signals in the respective detecting area within the single zone verification time, the respective security detector activates the control center for activating a local warning system to produce a local warning signal; and (c) verifying a multiple zone verification time with another security detector corresponding to a distance between the two security detectors at different detecting areas, wherein the multiple zone verification time must be longer than the single zone verification time in such a manner that when two security detectors are intercommunicated with each other to detect two triggered signals in the detecting areas respectively within the multiple zone verification time, at least one of the security detectors activates the control center for activating the local warning system to produce the local warning signal.

These and other objectives, features, and advantages of the present invention will become apparent from the following detailed description, the accompanying drawings, and the appended claims.

DETAILED DESCRIPTION OF THE PREFERRED EMBODIMENT

Referring to FIGS. 1 through 8 of the drawings, a security device for connecting to a local warning system comprising a control center and a plurality of security detectors which is electrically connected to the control center to intercommunicate with each other, wherein the security detectors are installed at a plurality of detecting areas respectively.

Figure 1:
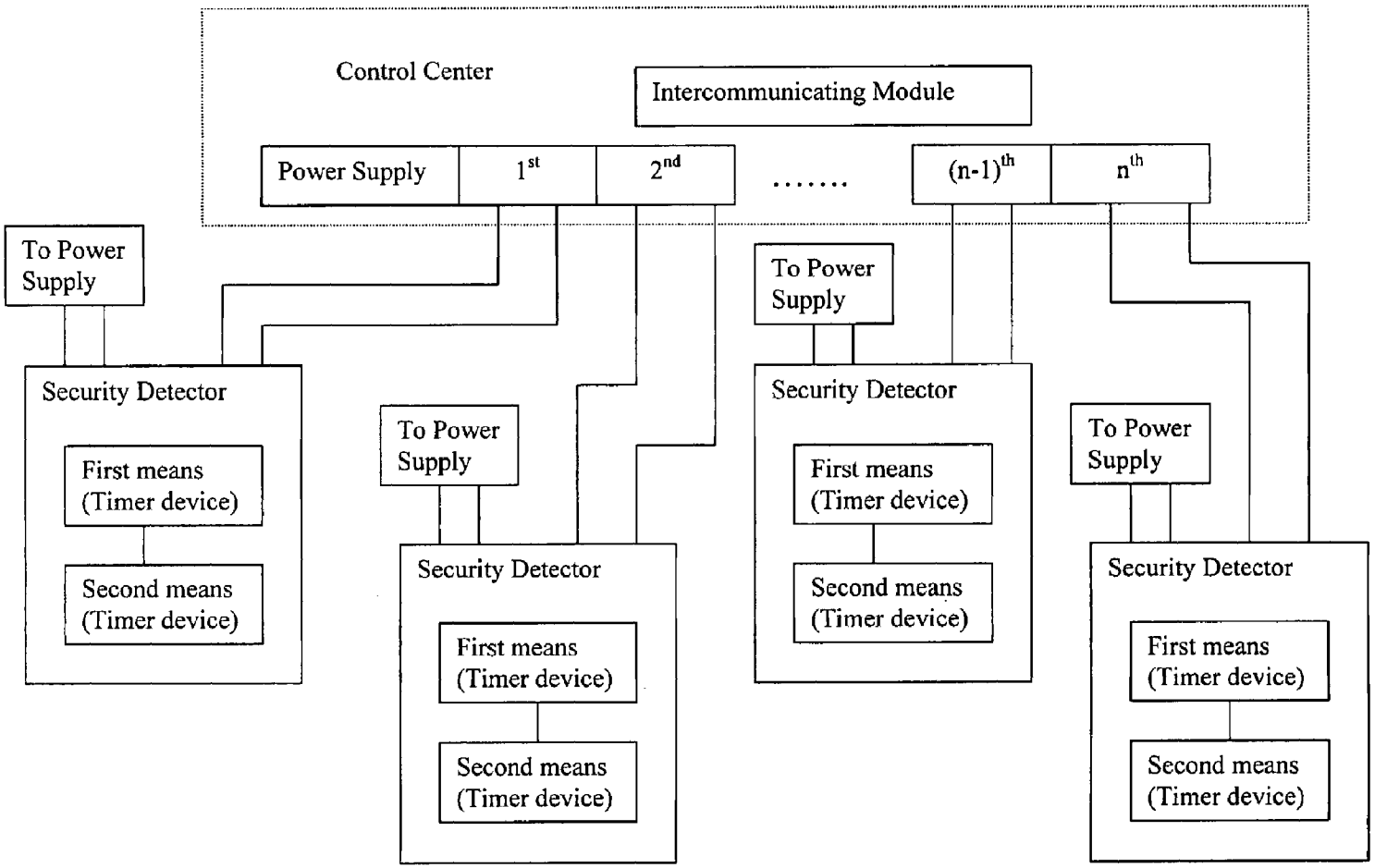
FIG. 1 is a block diagram of a security device with built-in intercommunicated false alarm reduction control according to a preferred embodiment of the present invention.
Figure 2:
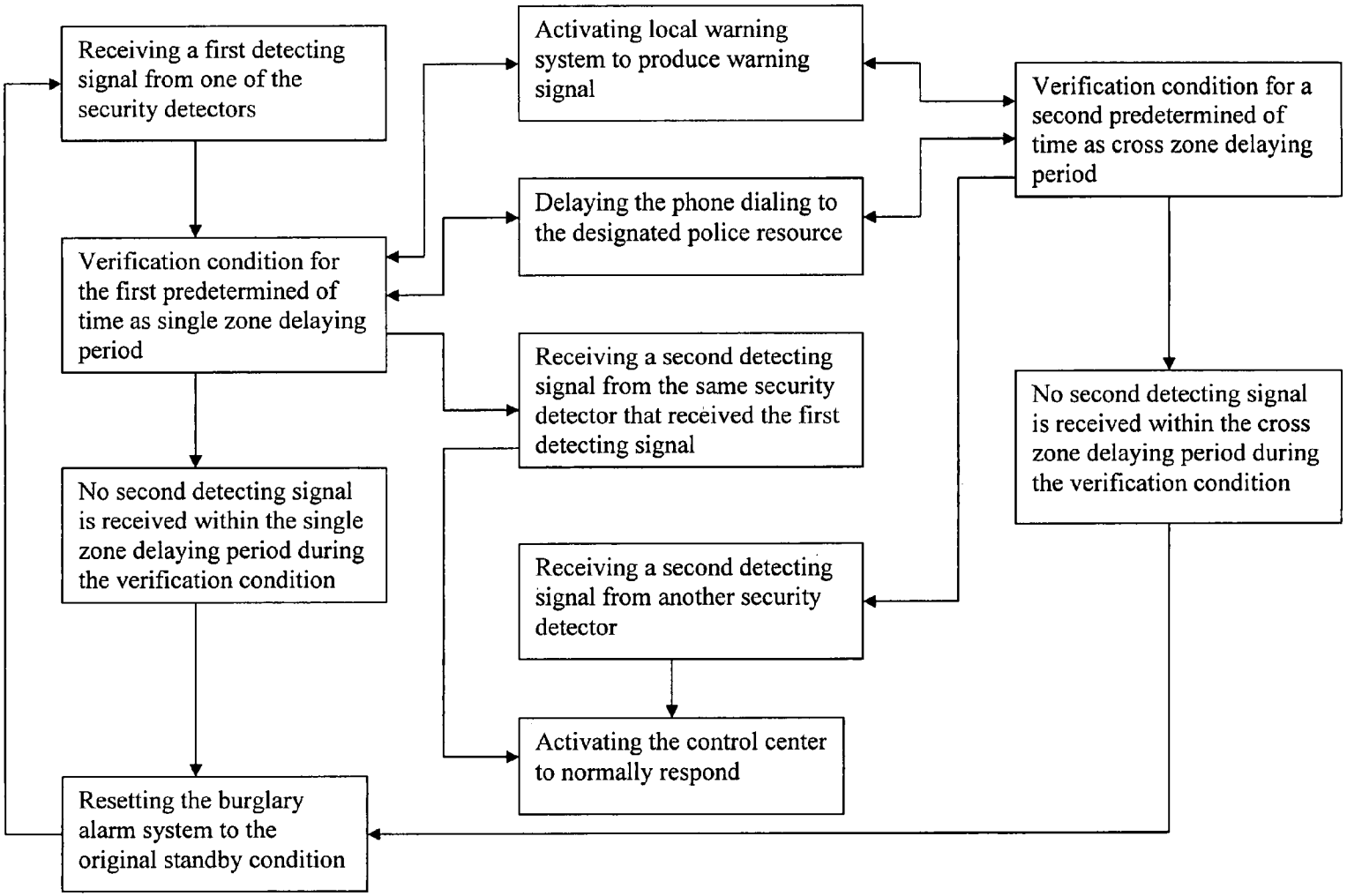
FIG. 2 is a flow chart of the security device with built-in intercommunicated false alarm reduction control according to the above preferred embodiment of the present invention.

The control center is electrically connected to a dialing system for transmitting signals to a central station for dispatching to a designated police resource when the dialing system is activated, as shown in FIG. 1.

Each of the security detectors comprises an intercommunicated false alarm reduction control comprising first means for verifying a single zone verification time of the respective security detector and second means for verifying a multiple zone verification time with another security detector corresponding to a distance between two security detectors at two different detecting areas. Accordingly, the first and second means are embodied as timer devices built-in with the security detectors, to delay the activation of the local warning system when one of the security detectors firstly detects the triggered signal.

According to the preferred embodiment, the single zone verification time is a single senor time delay for delaying an activation of the local warning system while the respective security detector is triggered. The multiple zone verification time is a multiple senor time delay for delaying the activation of the local warning system while the two security detectors at two different detecting areas are triggered, wherein the multiple zone verification time is longer than the single zone verification time.

When one of the security detectors detects at least two triggered signals in the respective detecting area within the single zone verification time, the respective security detector activates the control center for activating the local warning system to produce a local warning signal.

When two security detectors are intercommunicated with each other to detect two triggered signals in the detecting areas respectively within the multiple zone verification time, at least one of the security detectors activates the control center for activating the local warning system to produce the local warning signal.

The intercommunicated false alarm reduction control is mainly to configure a time frame for the security detectors of the security device to optimize both the false alarm reduction performance and the security protection performance, wherein a process of the intercommunicated false alarm reduction control comprises the following steps.

(1) Intercommunicate the security detectors with each other.

(2) Verify the single zone verification time for each of the security detectors, wherein when one of the security detectors detects at least two triggered signals in the respective detecting area within the single zone verification time, the respective security detector activates the control center for activating a local warning system to produce a local warning signal.

(3) Verify the multiple zone verification time with another security detector corresponding to the distance between the two security detectors at different detecting areas, wherein the multiple zone verification time must be longer than the single zone verification time in such a manner that when two security detectors are intercommunicated with each other to detect two triggered signals in the detecting areas respectively within the multiple zone verification time, at least one of the security detectors activates the control center for activating the local warning system to produce the local warning signal.

Accordingly, the single zone verification time and the multiple zone verification time are preset in the respective security detector to configure the time frame of each of the security detectors.

Figure 3:
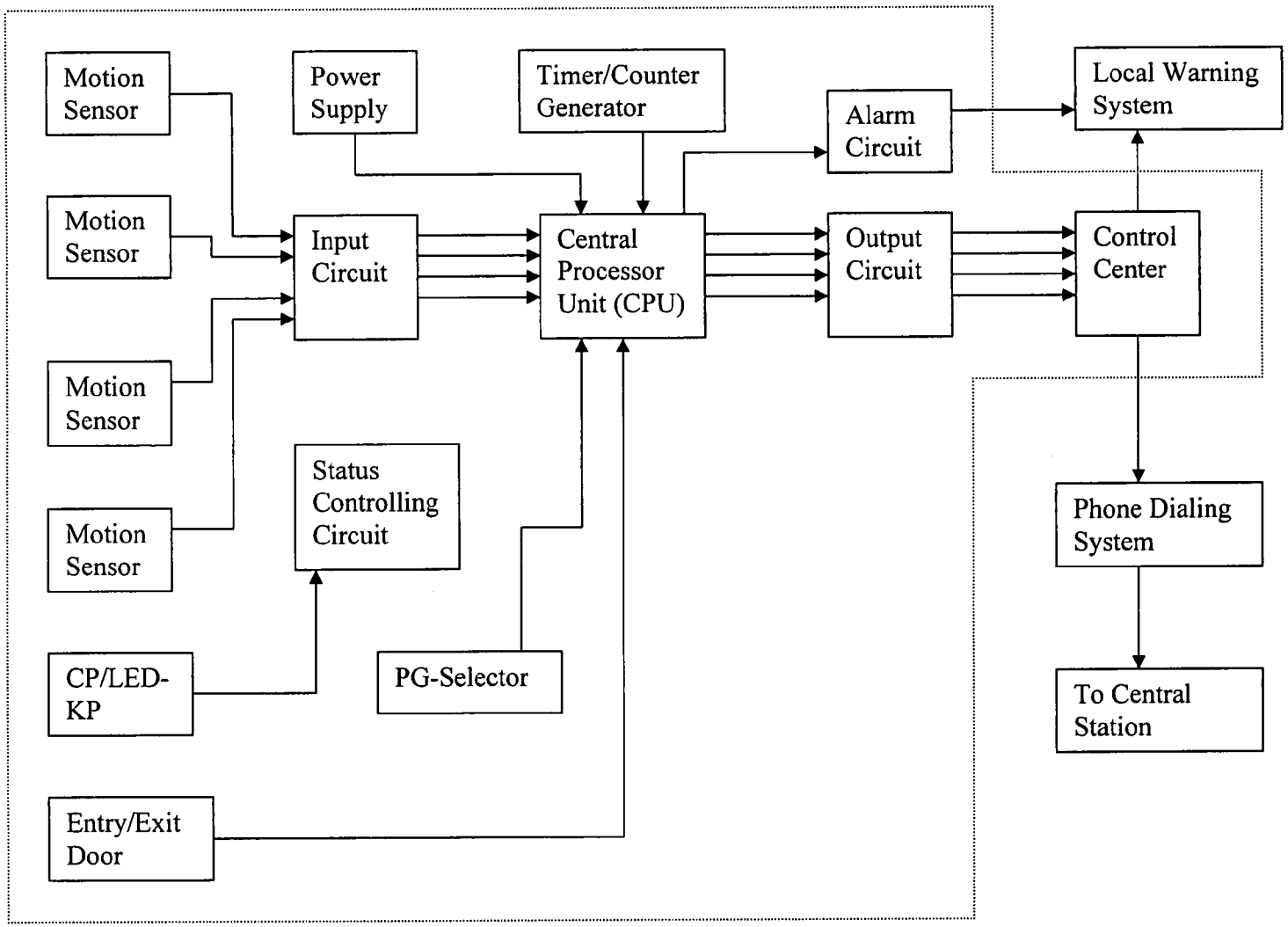
FIG. 3 is a block diagram of a process of reducing false alarm of the security device with built-in intercommunicated false alarm reduction control according to the above preferred embodiment of the present invention.

As shown in FIG. 3, the process for reducing false of the security device, which is activated by the alarm user by keying in the security code into an activating and deactivating keypad, comprises the steps as follows.

A. Activate the local warning system to produce a local warning signal for a designated period of time, normally two to five minutes, when any one of the security detectors detects a triggered signal within the respective detecting area during a standby condition of the security device.

B. Delay to activate the control center as well as the dialing system for a first preset time period as the single zone verification time and at least a second preset time period as the multiple zone verification time which is longer than the single zone verification time, wherein the security detector is in a verification condition during the single zone and multiple zone verification times.

C. Activate the control center to normally respond by activating the local warning system to produce warning signals and the dialing system to transmit digital signals to the central station when the same security detector that detected the triggered signal detects another signal in the same detecting area within the single zone verification time during the verification.

D. Activate the control center to normally respond by activating the local warning system to produce warning signals and the phone dialing system to transmit digital signals to the central station when another security detector detects another signal in another detecting area within the multiple zone verification time during the verification condition.

E. Reset the security detector to the original standby condition when there is no other signal is detected by any security detector during the verification condition, wherein the standby security detector is ready to enter the verification condition again when there is signal detected by any of the security detectors again.

Accordingly, the security detectors of the security device can be the motion sensors wherein each of the motion sensors is installed to provide a motion detecting area in such a manner that when one of the motion sensors detects a triggered motion as the signal, the respective motion sensor is activated in the verification condition. It is worth to mention that other kind of security detector can be used in the security device, such as a door/window sensor. In addition, different types of sensors can be used in the security device. For example, the door sensor is installed at the door entrance for detecting the signal of the door in an opened and closed manner while the motion sensor is installed at the living room for detecting the motion signal within the motion detecting area, wherein both the door sensor and the motion sensor are intercommunicated with each other and are electrically connected to the control center.

Figure 8:
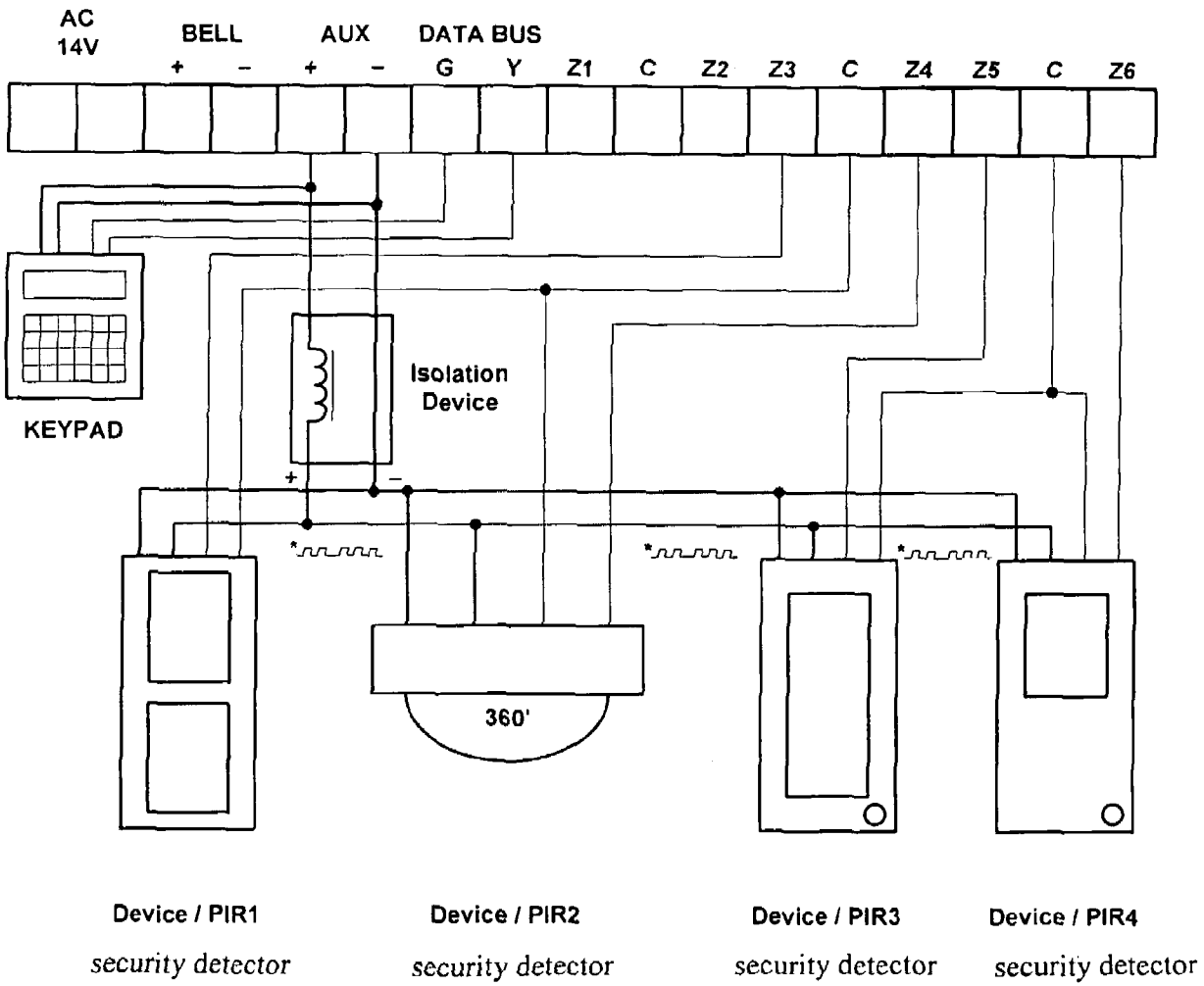
FIG. 8 illustrates a layout of the security detector of the security device with built-in intercommunicated false alarm reduction control according to the above preferred embodiment of the present invention.

As shown in FIGS. 1 and 8, each of the security detectors comprises a power cable electrically connected to a power supply of the control center and a signal cable communicatively connected to the control center to intercommunicate with another security detector. The power cable comprises two power links (positive and negative power) to electrically connect to the control center.

Figure 10:
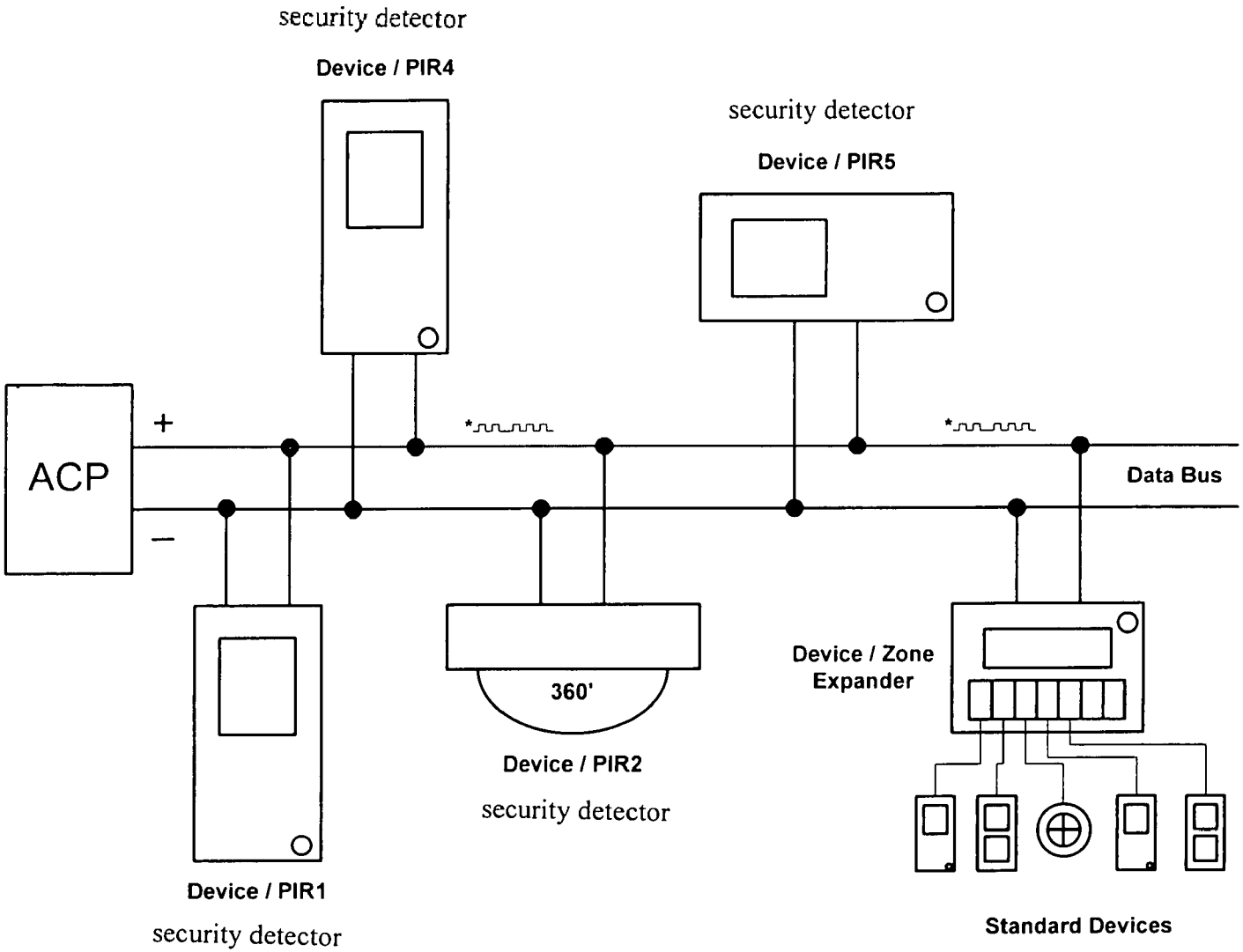
FIG. 10 illustrates a layout of the security detector of the security device with built-in intercommunicated false alarm reduction control according to the above preferred embodiment of the present invention, illustrating the data bus intercommunication between the security detectors.

Accordingly, the control center comprises an intercommunicating module connecting to the signal cables of the security detectors such that each of the security detectors sends and receives a communication signal (triggered signal) to the intercommunicating module through the signal cable to another security detector when a triggered signal is detected. The signal cable comprises two signal links to send and receive the communication signal between the security detectors such that the signal cable functions as a two-way communication link between the security detectors to intercommunicate the security detectors with each other. The intercommunicating module is embodied as a CAN (Control Area Network) Bus or a Data Bus to interconnect the security detectors with each other, as shown in FIG. 10.

Figure 7:
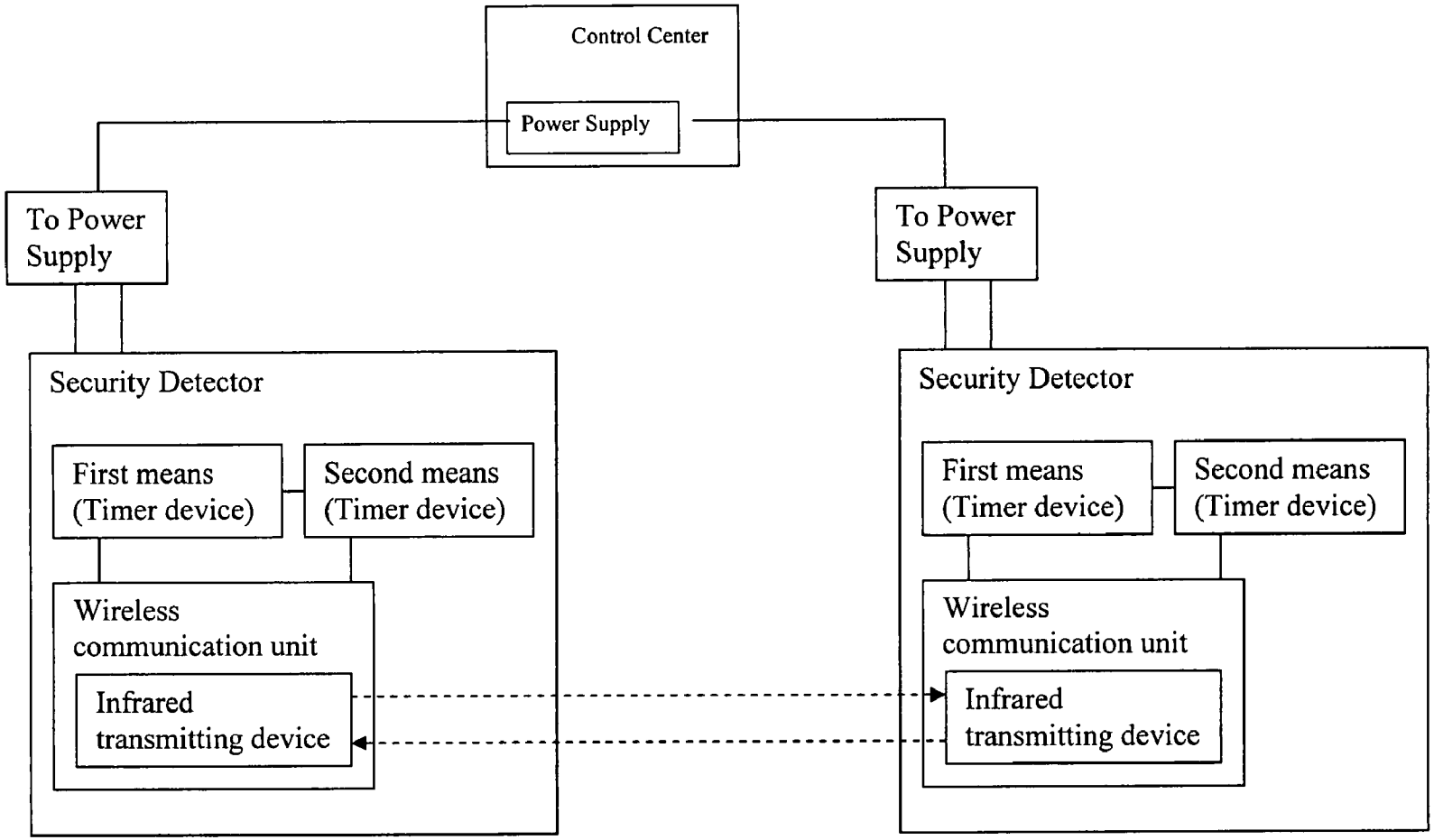
FIG. 7 illustrates an alternative mode of the security detector of the security device with built-in intercommunicated false alarm reduction control according to the above preferred embodiment of the present invention, illustrating the wireless communication between the security detectors.
Figure 9:
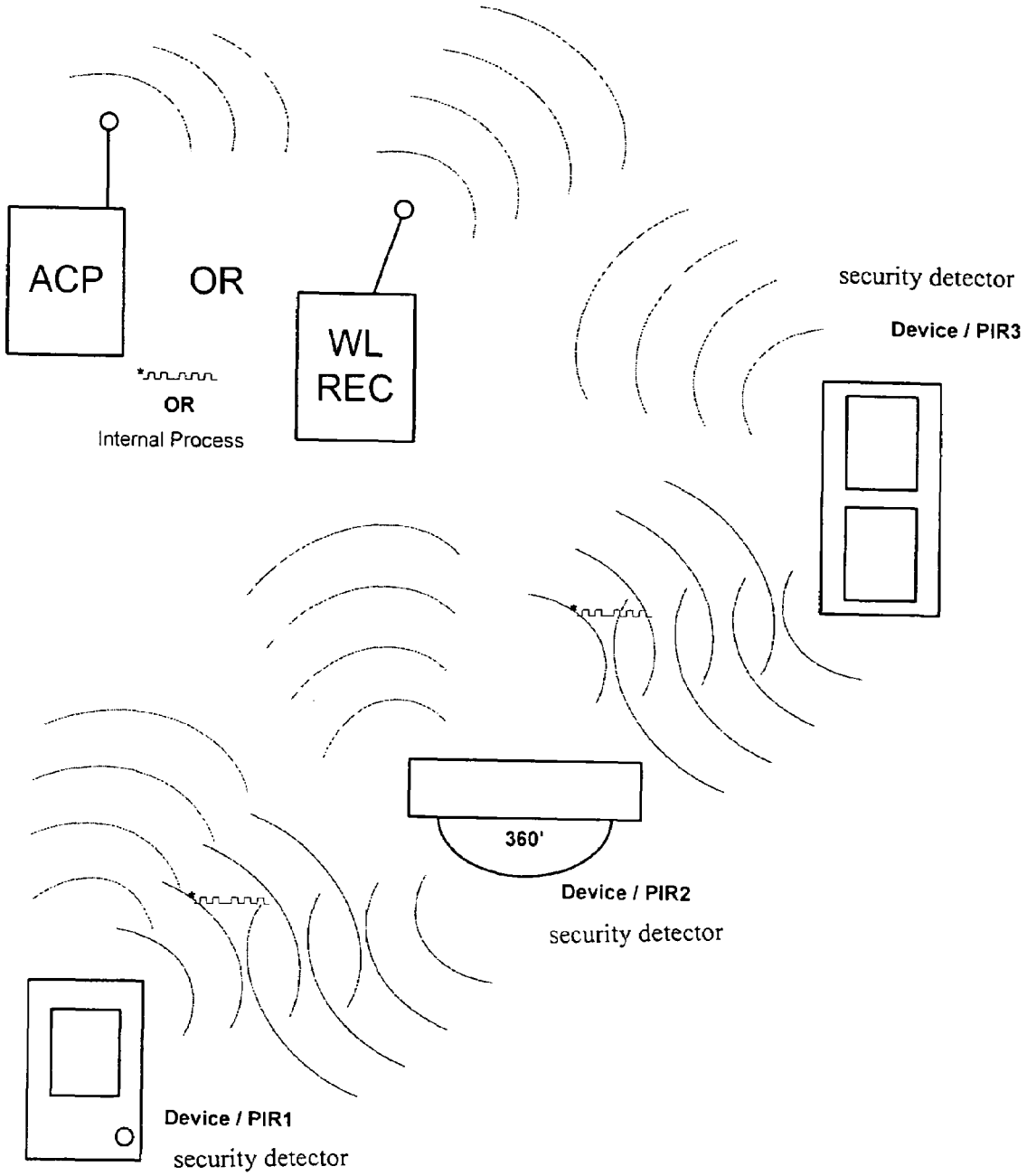
FIG. 9 illustrates a layout of the security detector of the security device with built-in intercommunicated false alarm reduction control according to the above preferred embodiment of the present invention, illustrating the wireless communication between the security detectors.

Alternatively, the security detectors are wirelessly intercommunicated with each other through a wireless communication unit, as shown in FIGS. 7 and 9, such that the security detectors exchange the communication signal with each other. The security detectors are electrically connected to the power supply of the control center through the power cables wherein each of the security detectors comprises an infrared transmitting device adapted to send and receive the communication signal (triggered signal) in form of infrared signal. Each of the security detectors is communicating with another security detectors through the infrared signal to remotely trigger another security detector when the first security detector detects the triggered signal in the respective detecting area such that the wireless communication unit functions as a wireless communication link between the security detectors to intercommunicate the security detectors with each other.

Likewise, each of the security detectors comprises a RF (radio frequency) transmitting device adapted to send and receive the communication signal (triggered signal) in form of RF signal. As shown in FIG. 9, each of the security detectors is communicating with another security detectors through the RF signal to remotely trigger another security detector when the first security detector detects the triggered signal in the respective detecting area such that the wireless communication unit functions as a wireless communication link between the security detectors to intercommunicate the security detectors with each other.

Figure 11:
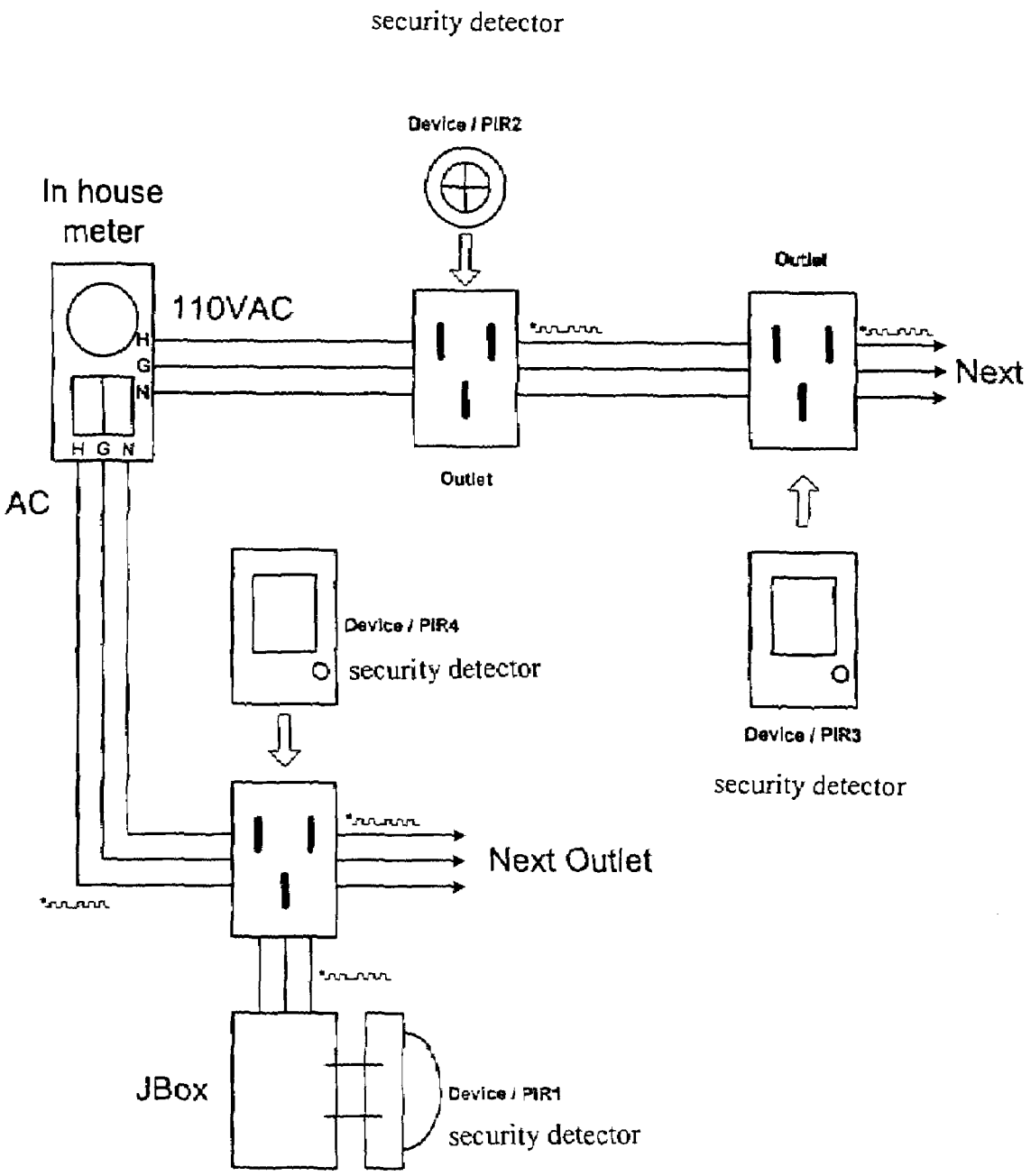
FIG. 11 illustrates a layout of the security detector of the security device with built-in intercommunicated false alarm reduction control according to the above preferred embodiment of the present invention, illustrating the power line intercommunication between the security detectors.

In addition, the security detectors are intercommunicated to exchange the communication signal through a power line, as shown in FIG. 11. Each of the security detectors is electrically connected to the power outlet such that the security detectors are interconnected to exchange the communication signal through the power line.

Figure 12:
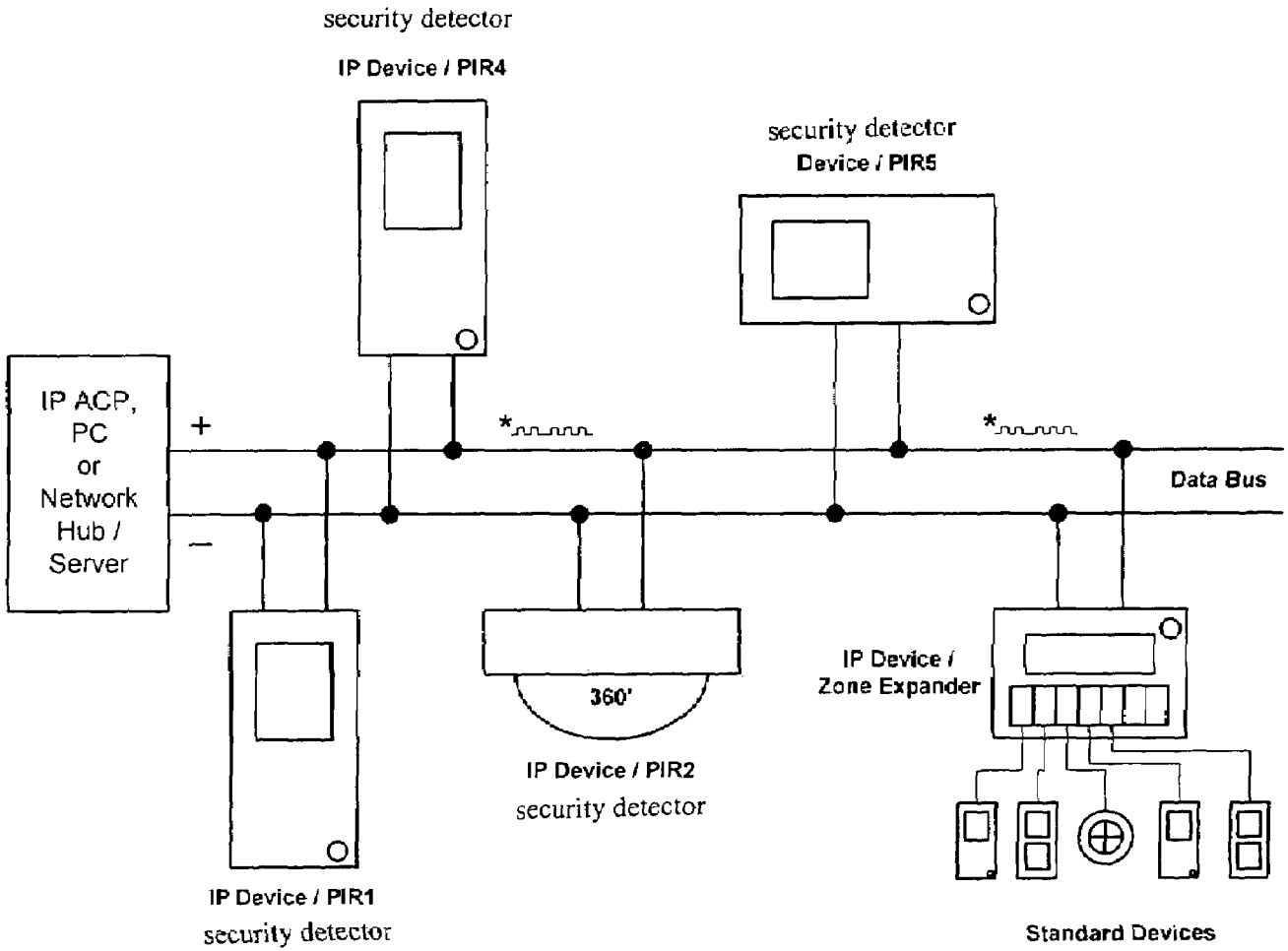
FIG. 12 illustrates a layout of the security detector of the security device with built-in intercommunicated false alarm reduction control according to the above preferred embodiment of the present invention, illustrating the IP networking intercommunication between the security detectors.

Furthermore, the security detectors are intercommunicated to exchange the communication signal through an IP networking, as shown in FIG. 12. Each of the security detectors is networked through an IP networking system such that the security detectors are interconnected to exchange the communication signal through the IP networking.

According to the preferred embodiment, the process of reducing the false alarm for the security device is incorporated with an intercommunicated false alarm reduction control to optimize the false alarm reduction performance and the security protection performance. The sensitivities of the single zone verification time and the multiple zone verification time with respect to the false alarm possibility and security protection for the alarm system are determined by a single zone verification analysis and a multiple zone verification analysis respectively.

Figure 6:
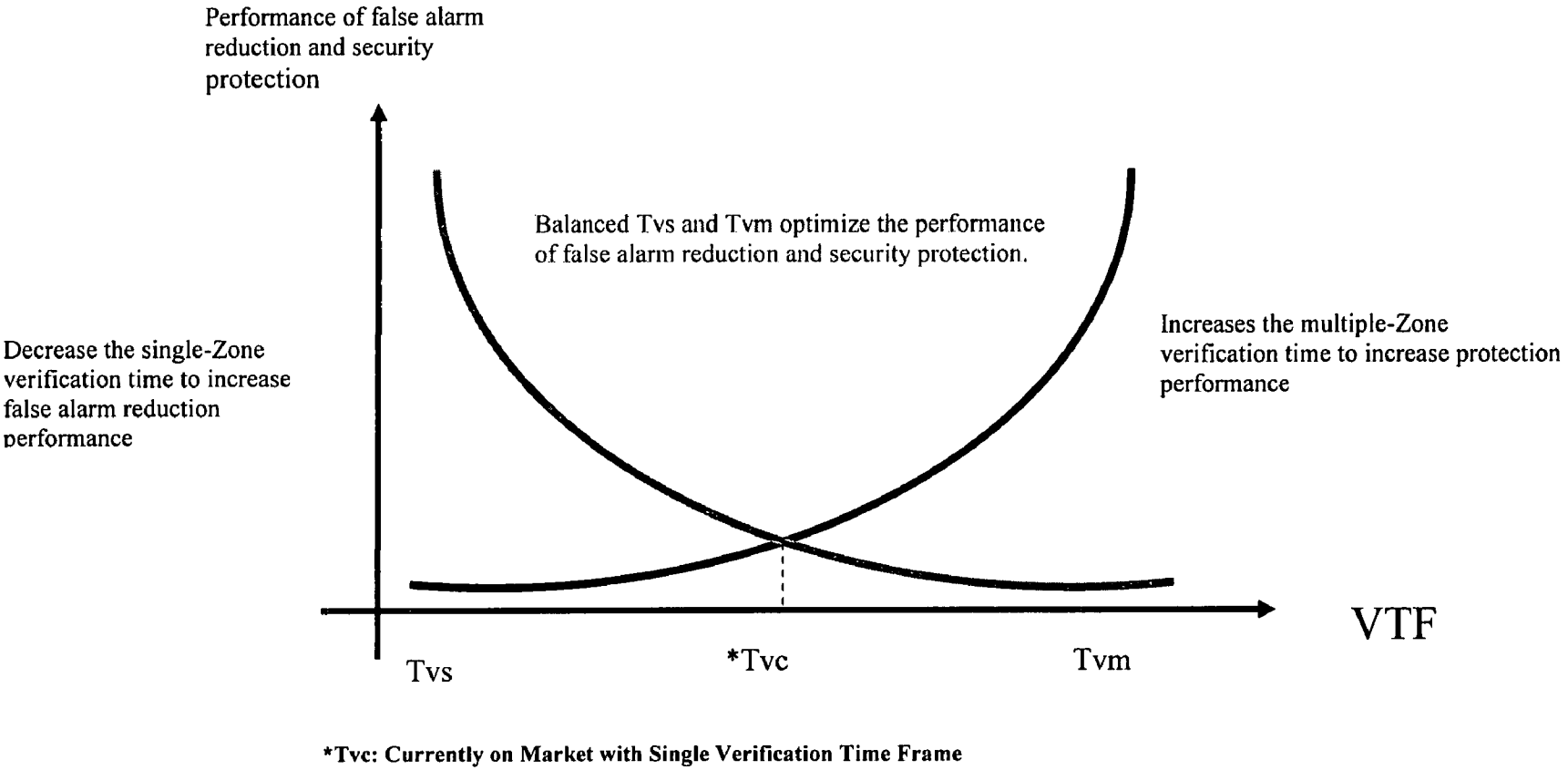
FIG. 6 is a graph of the digital verification control process for the security device with built-in intercommunicated false alarm reduction control according to the above preferred embodiment of the present invention, illustrating the combination of the single zone verification analysis and the multiple zone verification analysis.

As shown in FIG. 6, the single zone verification analysis is performed for analyzing a relationship between the single zone verification time and a performance of false alarm reduction and security protection, wherein a single zone verification curve is formed to indicate when the single zone verification time is increased, the performance of false alarm reduction and security protection reduced. In other words, while decreasing the single zone verification time, the false alarm reduction performance will be increased.

In addition, the multiple zone verification analysis is performed for analyzing a relationship between the multiple zone verification time and the performance of false alarm reduction and security protection, wherein a multiple zone verification curve is formed to indicate when a multiple zone verification time is increased, the performance of false alarm reduction and security protection increased.

As it is mentioned in the background, the single zone verification time, which is the same as the multiple zone verification time, for the conventional alarm system is determined by combining the single zone verification analysis and the multiple zone verification analysis, wherein the conventional verification time is preset at an intersection of the single zone verification curve and the multiple zone verification curve.

Figure 4:
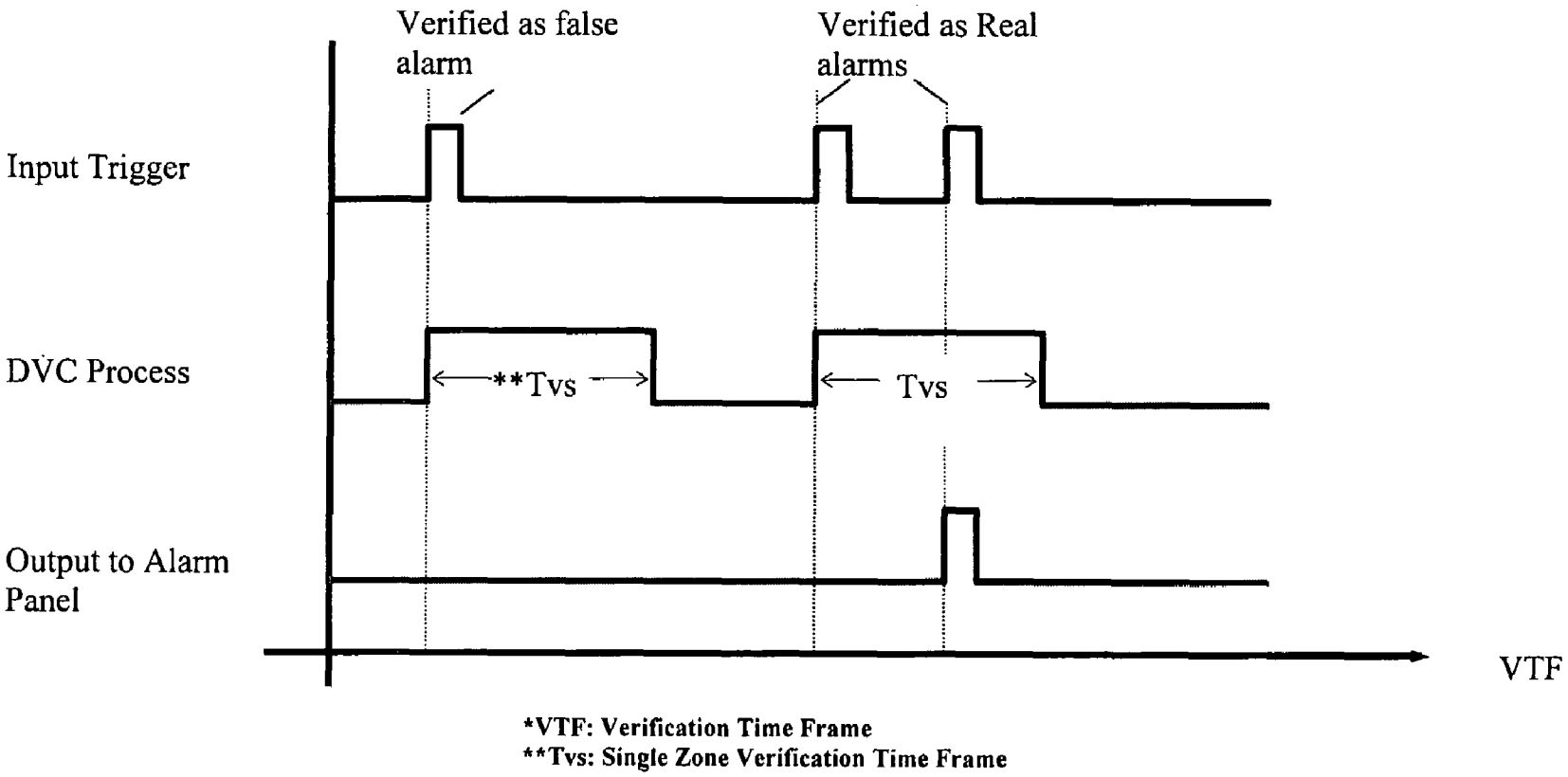
FIG. 4 is a graph of a single zone verification analysis of a digital verification control process for the security device with built-in intercommunicated false alarm reduction control according to the above preferred embodiment of the present invention.
Figure 13:
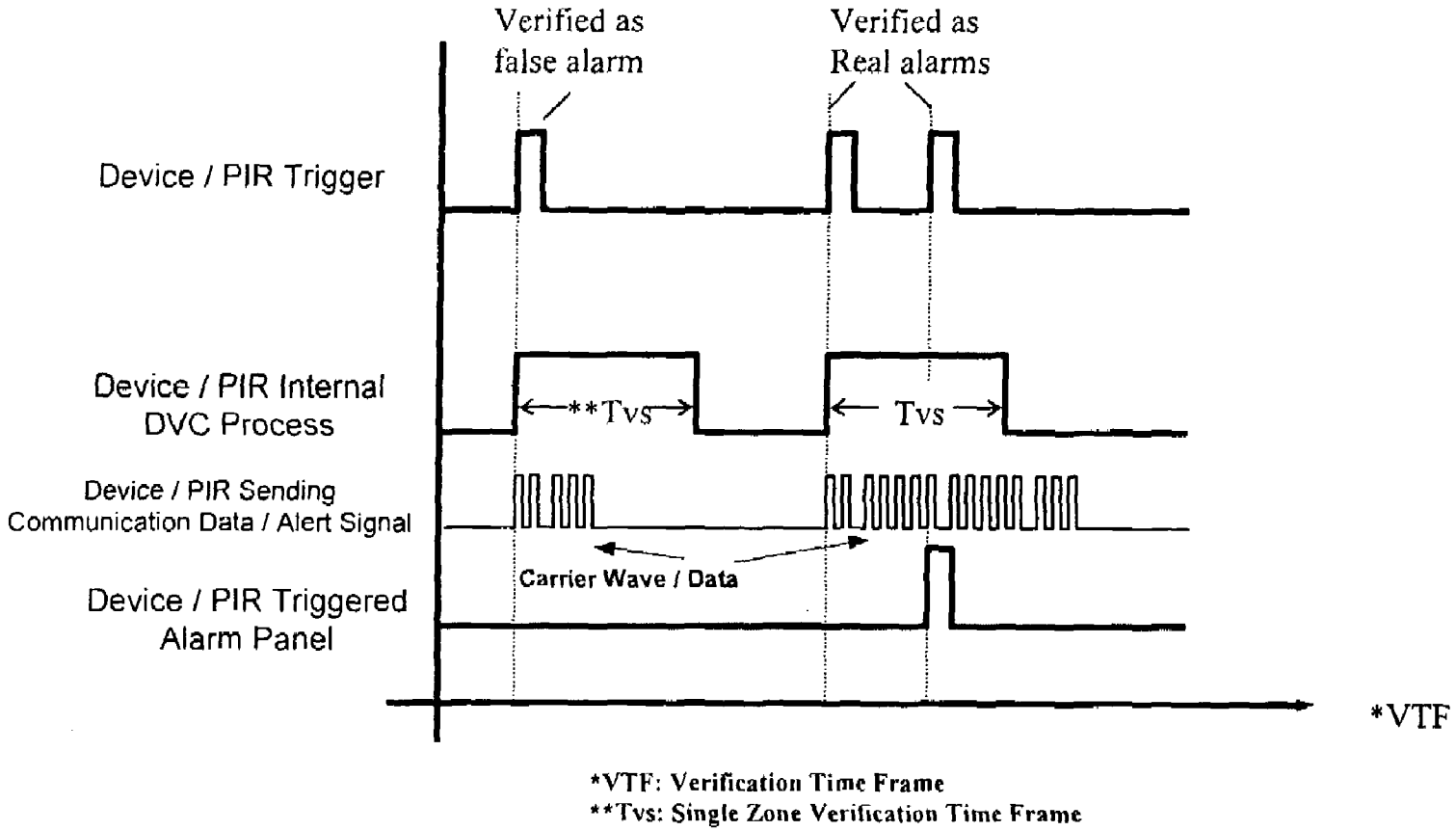
FIG. 13 illustrates the processing logic of the single zone verification processing of the security detector of the security detector of the security device with built-in intercommunicated false alarm reduction control according to the above preferred embodiment of the present invention.

According to the preferred embodiment, the single zone verification analysis is performed to verify the single zone verification time so as to reduce the false alarm possibility of the security device. As shown in FIG. 4, when the triggered signal is first received by one of the security detectors within the respective detecting area, the single zone verification is started while the security detector is in the verification condition. If there is no another signal is detected by the same security detector within the single zone verification time, the security detector is reset back to the standby condition so that no local warming signal and no digital signal is transmitted to the central station. Therefore, there is a false alarm. It is worth to mention that when the triggered signal is first received by one of the security detectors within the respective detecting area, the respective security detector sends out the communication signal to intercommunicate with another security detector, as shown in FIG. 13.

When another signal is detected by the same security detector within the single verification time, the local warning system is activated to produce warning signals and the dialing system is activated to transmit digital signals to the central station.

The single zone verification analysis mainly verifies the single verification time with respect to the false alarm possibility. When the single zone verification time is lengthened to reduce the false alarm possibility, the security protection of the alarm system will be decreased. Therefore, by varying the single zone verification time, the single zone verification curve is plotted to indicate the relationship between the single zone verification time and the performance of false alarm reduction and security protection, as shown in FIG. 6.

After finishing the single zone verification analysis, the multiple zone verification analysis should be performed to verify the multiple zone verification time so as to reduce the false alarm possibility of the security device.

Figure 5:
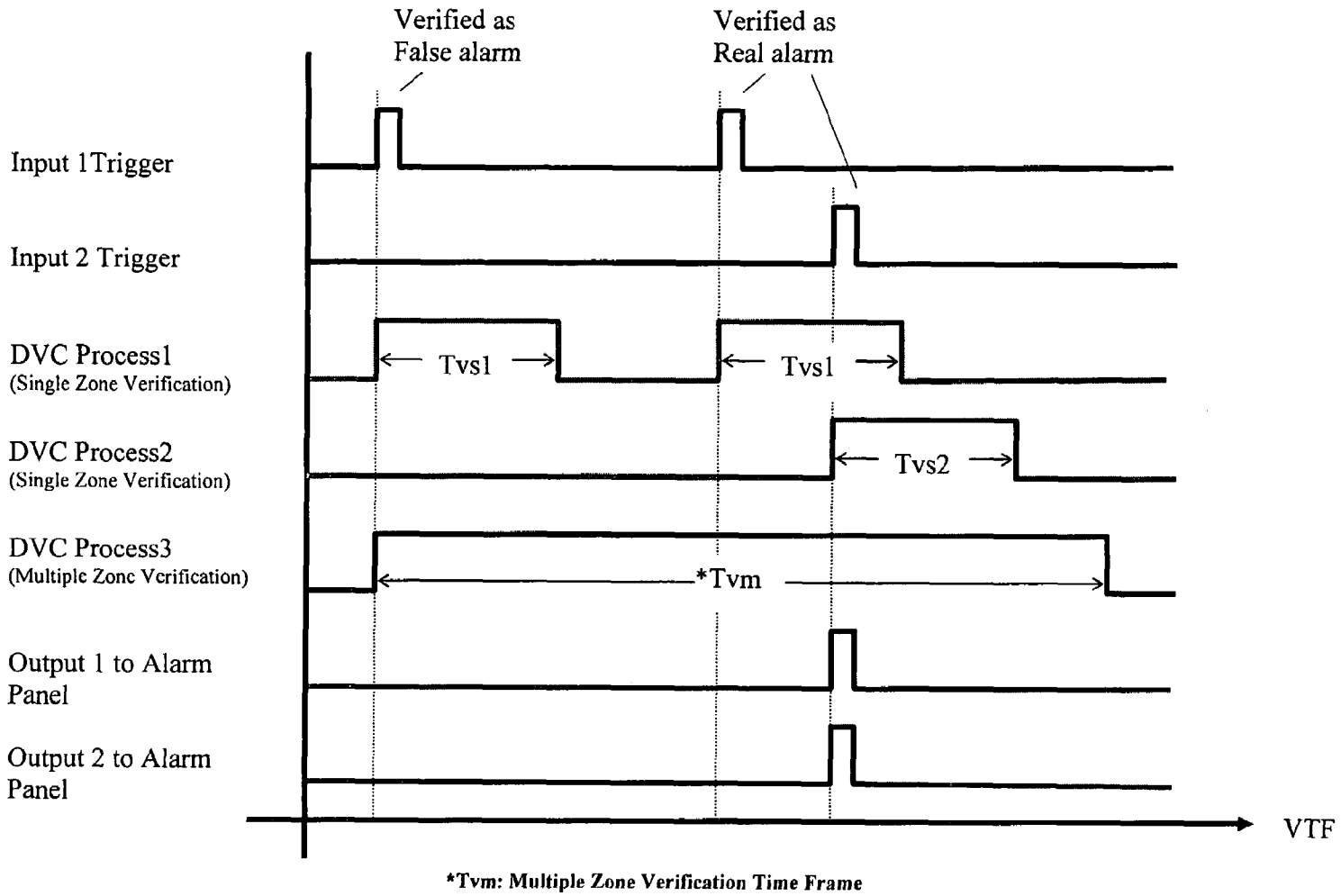
FIG. 5 is a graph of a multiple zone verification analysis of the digital verification control process for the security device with built-in intercommunicated false alarm reduction control according to the above preferred embodiment of the present invention.
Figure 14:
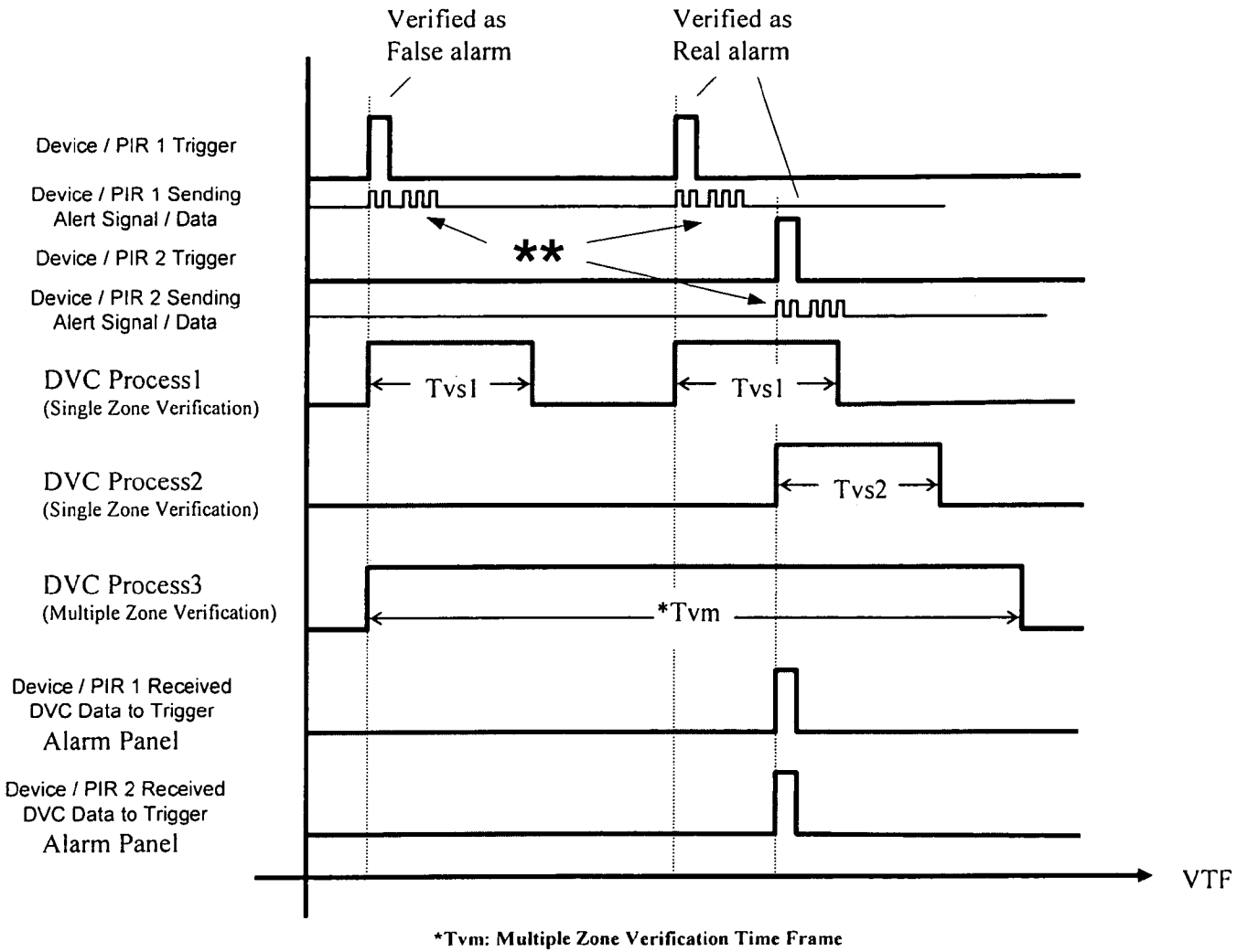
FIG. 14 illustrates the processing logic of the multiple zone verification processing of the security detectors of the security detector of the security device with built-in intercommunicated false alarm reduction control according to the above preferred embodiment of the present invention.
Figure 15:
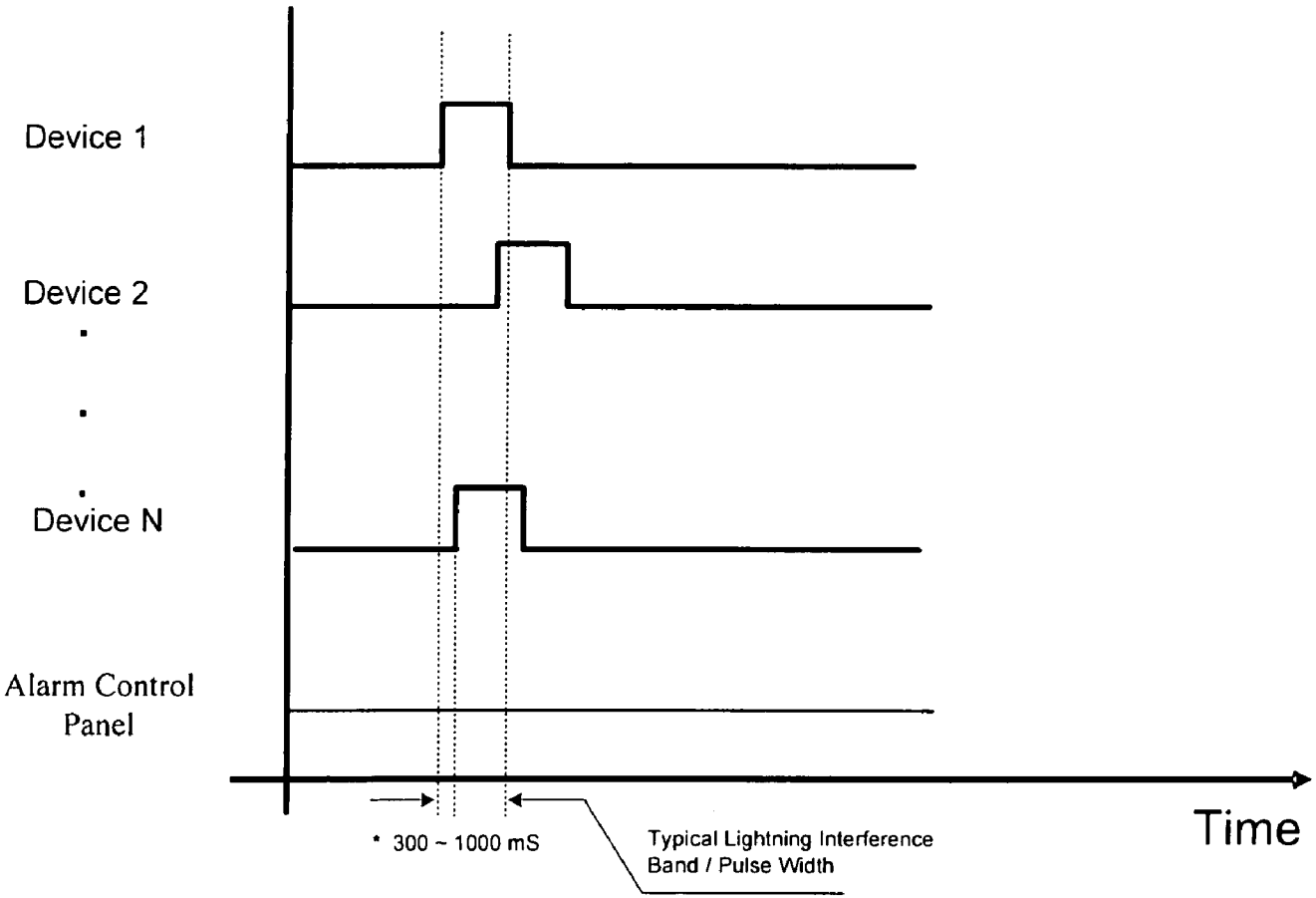
FIG. 15 illustrates a lightning block process method of the security detector of the security device with built-in intercommunicated false alarm reduction control according to the above preferred embodiment of the present invention.
Figure 16:
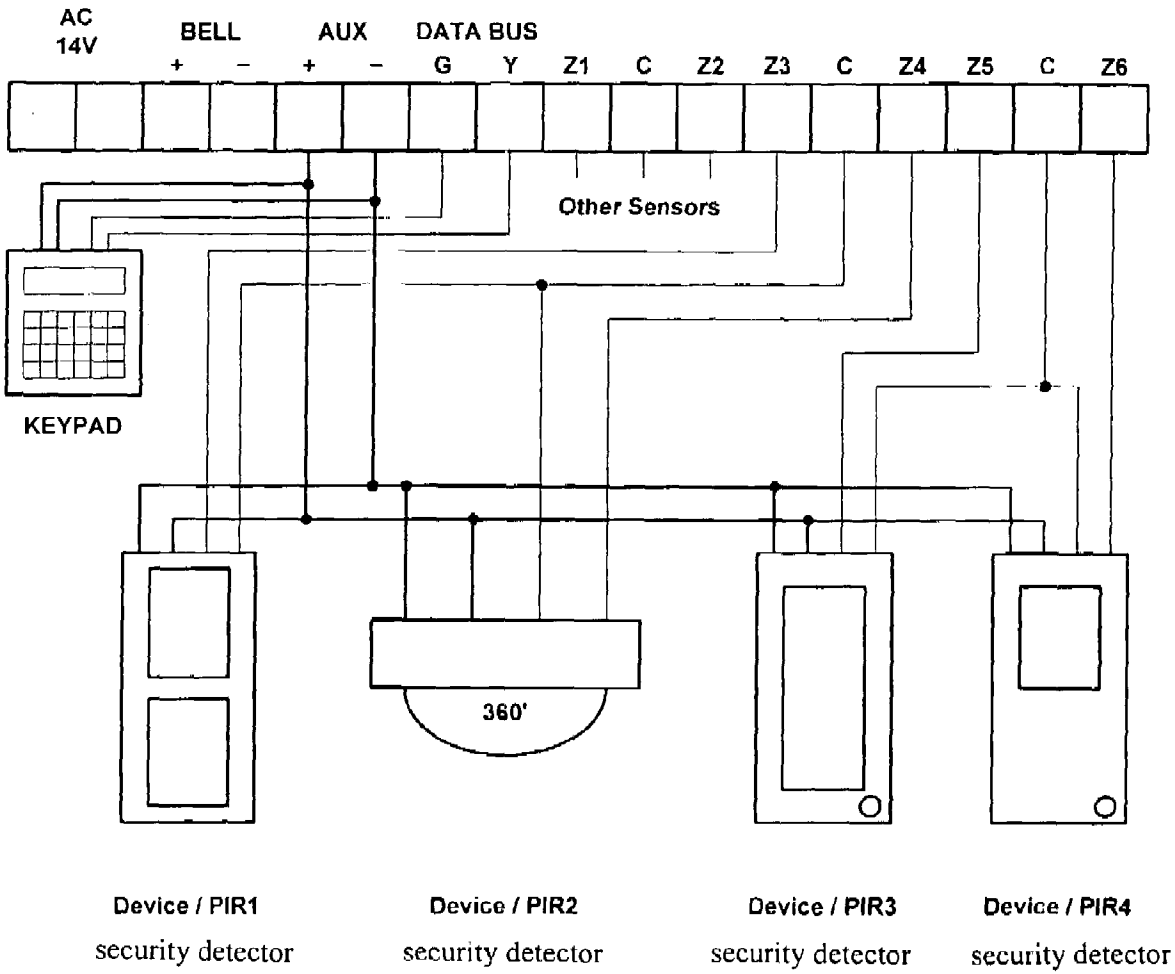
Fig. 16 Prior Art
FIG. 16 is a layout of the conventional security system.

As shown in FIG. 5, when the triggered signal is first received by one of the security detectors within the respective detecting area, both the single zone verification and the multiple zone verification are started at the same time. Since the security detectors are intercommunicated with each other, the security detectors are in the verification condition. If there is no second signal is detected either by the same security detector within the single zone verification time or by another security detector within the multiple zone verification time, the security detectors are reset back to the standby condition, so that no local warming signal and no digital signal is transmitted to the central station. Therefore, there is a false alarm. It is worth to mention that when the triggered signal is first received by one of the security detectors within the respective detecting area, the respective security detector sends out the communication signal to intercommunicate with another security detector. When the triggered signal is detected by the second security detector within the multiple zone verification time, the second security detector also sends out the communication signal to intercommunicate with another security detector, as shown in FIG. 14. In other words, the security detectors exchange the communication signal with each other when one of the security detectors detects the triggered signal to process the single zone verification and the multiple zone verification. It is worth to mention that the security detectors can also incorporate with a lightning block processing as shown in FIG. 15.

When another security detector detects the second signal within the respective detecting area within the multiple zone verification area, the local warning system is activated to produce warning signals and the dialing system is activated to transmit digital signals to the central station. It is worth to mention that when the second security detector detects the second signal, the single zone verification time of the second sensor will be simultaneously started. Therefore, the multiple zone verification time must be set longer than the single zone verification time.

The multiple zone verification analysis mainly verifies the multiple verification time with respect to the false alarm possibility. When the multiple zone verification time is lengthened to reduce the false alarm possibility, the security protection of the security device will be increased. Therefore, by varying the multiple zone verification time, the multiple zone verification curve is plotted to indicate the relationship between the multiple zone verification time and the performance of false alarm reduction and security protection, as shown in FIG. 6.

As a result, the single zone verification curve and the multiple zone verification curve are formed after performing the single zone verification analysis and the multiple zone verification analysis respectively. Since both the single zone verification curve and the multiple zone verification curve are related to the performance of false alarm reduction and security protection with respect to the time frame. Therefore, the results of the single zone verification analysis and the multiple zone verification analysis can be combined to overlap the single zone verification curve and the multiple zone verification curve in accordance with the performance of false alarm reduction and security protection and the time frame, as shown in FIG. 6. It is worth to mention that the results of the single zone verification analysis and the multiple zone verification analysis are sent to the central station such that the experienced alarm consultant at the central station is able to analysis the optimum verification times, i.e. the optimum single zone verification time and the optimum multiple zone verification time, so as to minimize any computerized error during calculation.

The optimum single zone verification time, which is based on the single zone verification analysis, is determined by taking derivative with respect to time. As shown in FIG. 6, the single zone verification time should preset at a range from 5 to 15 seconds to obtain optimum the false alarm reduction performance. Accordingly, the optimum single zone verification time should be preset at 10 seconds.

The optimum multiple zone verification time, which must be longer than the single zone verification time, is determined based on the multiple zone verification analysis by taking derivative with respect to time. As shown in FIG. 5, the multiple zone verification time is preset less than 2 minutes to obtain the optimum security protection performance. Accordingly, the optimum multiple zone verification time should be preset at 2 minutes.

It is worth to mention that since the single zone verification time is determined by the single zone verification curve through the single zone verification analysis and the multiple zone verification time is determined by the multiple zone verification curve through the multiple zone verification analysis, the single zone verification time and the multiple zone verification time are capable of presetting at any conventional alarm system as a time configuration thereof to maximize the performance of false alarm reduction and security protection of the security device.

Accordingly, the process of the intercommunicated false alarm reduction control is effective in all types of false alarms:

| Type of False Alarm | Percent | False Alarm Reduction Rate |
|---|---|---|
| Generated Fortuitously | 30% | 100% |
| Generated with Certain Patterns | 60% | 98% |
| Bad Environment, e.g. outdoor applications | 10% | 95% |

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A security device, comprising:

a control center adapted for connecting to a local warning system;

a plurality of security detectors, which is electrically connected to said control center to intercommunicate with each other, installed at a plurality of detecting areas respectively, wherein each of said security detectors comprises an intercommunicated false alarm reduction control comprising:

first means for verifying a single zone verification time of said respective security detector, wherein said single zone verification time is a single senor time delay for delaying an activation of the local warning system while said respective security detector is triggered; and second means for verifying a multiple zone verification time with another said security detector corresponding to a distance between said two security detectors at two different detecting areas, wherein said multiple zone verification time is a multiple senor time delay for delaying said activation of the local warning system while said two security detectors at two different detecting areas are triggered, wherein said multiple zone verification time is longer than said single zone verification time;

wherein when one of said security detectors detects at least two triggered signals in said respective detecting area within said single zone verification time, said respective security detector activates the control center for activating said local warning system to produce a local warning signal;

wherein when said two security detectors are intercommunicated with each other to detect two triggered signals in said detecting areas respectively within said multiple zone verification time, at least one of said security detectors activates said control center for activating said local warning system to produce said local warning signal.

2. The security device, as recited in claim 1, wherein said first means and said second means are timer devices respectively built-in with each of said security detectors for delaying said activation of said local warning system when one of said security detectors is firstly triggered.

3. The security device, as recited in claim 1, further comprising a wireless communication unit electrically connected to each of said security detectors, wherein said wireless communication unit wirelessly sending and receiving said triggered signal from one of said security detectors to another said security detector so as to wirelessly intercommunicate said security detectors with each other.

4. The security device, as recited in claim 2, further comprising a wireless communication unit electrically connected to each of said security detectors, wherein said wireless communication unit wirelessly sending and receiving said triggered signal from one of said security detectors to another said security detector so as to wirelessly intercommunicate said security detectors with each other.

5. The security device, as recited in claim 3, wherein said wireless communication unit comprises an infrared transmitting device adapted to send and receive said triggered signal in form of infrared signal, wherein each of said security detectors is communicating with another said security detectors through said infrared signal to remotely trigger another said security detector when said first security detector detects said triggered signal in said respective detecting area such that said wireless communication unit functions as a wireless communication link between said security detectors to intercommunicate said security detectors with each other.

6. The security device, as recited in claim 4, wherein said wireless communication unit comprises an infrared transmitting device adapted to send and receive said triggered signal in form of infrared signal, wherein each of said security detectors is communicating with another said security detectors through said infrared signal to remotely trigger another said security detector when said first security detector detects said triggered signal in said respective detecting area such that said wireless communication unit functions as a wireless communication link between said security detectors to intercommunicate said security detectors with each other.

7. The security device, as recited in claim 1, wherein said control center comprises an intercommunicating module connecting to said security detectors, wherein each of said security detectors comprises a signal cable communicatively connected to said intercommunicating module such that each of the security detectors sends and receives said triggered signal to said intercommunicating module through said signal cable to another said security detector when said first security detector detects said triggered signal in said respective detecting area.

8. The security device, as recited in claim 2, wherein said control center comprises an intercommunicating module connecting to said security detectors, wherein each of said security detectors comprises a signal cable communicatively connected to said intercommunicating module such that each of the security detectors sends and receives said triggered signal to said intercommunicating module through said signal cable to another said security detector when said first security detector detects said triggered signal in said respective detecting area.

9. The security device, as recited in claim 7, wherein said signal cable comprises two signal links to send and receive said triggered signal between said security detectors such that said signal cable functions as a two-way communication link between said security detectors to intercommunicate said security detectors with each other.

10. The security device, as recited in claim 8, wherein said signal cable comprises two signal links to send and receive said triggered signal between said security detectors such that said signal cable functions as a two-way communication link between said security detectors to intercommunicate said security detectors with each other.

11. A process of a verification control for a security device which comprises a control center and a plurality of security detectors installed at a plurality of detecting areas respectively and electrically connected to said control center, comprising the steps of:

(a) intercommunicating said security detectors with each other;

(b) verifying a single zone verification time for each of said security detectors, wherein when one of said security detectors detects at least two triggered signals in said respective detecting area within said single zone verification time, said respective security detector activates said control center for activating a local warning system to produce a local warning signal; and (c) verifying a multiple zone verification time with another said security detector corresponding to a distance between said two security detectors at different detecting areas, wherein said multiple zone verification time must be longer than said single zone verification time in such a manner that when said two security detectors are intercommunicated with each other to detect two triggered signals in said detecting areas respectively within said multiple zone verification time, at least one of said security detectors activates said control center for activating said local warning system to produce said local warning signal.

12. The process, as recited in claim 11, each of said security detectors comprises first means for verifying said single zone verification time of said respective security detector and second means for verifying said multiple zone verification time with another said security detector corresponding to a distance between said two security detectors at two different detecting areas.

13. The process, as recited in claim 12, wherein said first means and said second means are timer devices respectively built-in with each of said security detectors for delaying said activation of said local warning system when one of said security detectors is firstly triggered.

14. The process as recited in claim 11, in step (a), further comprising the steps of:

(a.1) wirelessly connecting said security detectors to intercommunicate said security detectors with each other; and (a.2) wirelessly sending and receiving said triggered signal from one of said security detectors to another said security detector when said first security detector detects said triggered signal within said respective detecting area.

15. The process as recited in claim 13, in step (a), further comprising the steps of:

(a.1) wirelessly connecting said security detectors to intercommunicate said security detectors with each other; and (a.2) wirelessly sending and receiving said triggered signal from one of said security detectors to another said security detector when said first security detector detects said triggered signal within said respective detecting area.

16. The process, as recited in claim 14, wherein each of said security detectors is communicating with another said security detectors through said triggered signal in form of infrared signal to remotely trigger another said security detector when said first security detector detects said triggered signal in said respective detecting area.

17. The process, as recited in claim 15, wherein each of said security detectors is communicating with another said security detectors through said triggered signal in form of infrared signal to remotely trigger another said security detector when said first security detector detects said triggered signal in said respective detecting area.

18. The process as recited in claim 11, in step (a), further comprising the steps of:

(a.1) interconnecting signal cables of said security detectors with each other through an intercommunicating module; and (a.2) sending and receiving said triggered signal to said intercommunicating module through said signal cable to another said security detector when said first security detector detects said triggered signal in said respective detecting area.

19. The process as recited in claim 13, in step (a), further comprising the steps of:

(a.1) interconnecting signal cables of said security detectors with each other through an intercommunicating module; and (a.2) sending and receiving said triggered signal to said intercommunicating module through said signal cable to another said security detector when said first security detector detects said triggered signal in said respective detecting area.

20. The process, as recited in claim 18, wherein said signal cable comprises two signal links to send and receive said triggered signal between said security detectors such that said signal cable functions as a two-way communication link between said security detectors to intercommunicate said security detectors with each other.

21. The process, as recited in claim 19, wherein said signal cable comprises two signal links to send and receive said triggered signal between said security detectors such that said signal cable functions as a two-way communication link between said security detectors to intercommunicate said security detectors with each other.

* * * * *